US005769398A

United States Patent [19]

Samejima

[11] Patent Number: 5,769,398

[45] Date of Patent: Jun. 23, 1998

[54] LEVER HOIST

[75] Inventor: Yasuhiro Samejima, Osaka, Japan

[73] Assignee: Vital Kogyo Kabushiki Kaisha, Osaka, Japan

[21] Appl. No.: 854,624

[22] Filed: May 12, 1997

[30] Foreign Application Priority Data

Aug. 13, 1996 [JP] Japan ..... 8-232603

[51] Int. Cl.[6] ..... B66D 3/14

[52] U.S. Cl. ..... 254/352; 192/95; 254/369

[58] Field of Search ..... 254/352, 353, 254/369, 368; 192/95

[56] References Cited

U.S. PATENT DOCUMENTS 4,469,308 9/1984 Nakamura et al. ..... 254/352
5,238,226 8/1993 Nishimura ..... 254/352
5,421,553 6/1995 Hashiue ..... 254/352
5,472,171 12/1995 Nishi et al. ..... 254/352
5,575,457 11/1996 Inoue et al. ..... 254/352

*Primary Examiner*—Katherine Matecki
*Attorney, Agent, or Firm*—Lockwood, Alex, FitzGibbon & Cummings

[57] ABSTRACT

A lever-type hoist comprising a pressure receiving member 6, a press drive member 7 adapted to press-drive the pressure receiving member 6 through friction members 8, 9 and a reverse rotation stop ring 10, and a coil spring 13 interposed between the pressure receiving member and press-drive member, the base engaging portion 13*b* of coil spring 13 being engaged by an engaging groove 6*d* of pressure receiving member and the tip engaging portion of coil spring 13 being engaged by an engaging surface 7*k* of press-drive member, with an inclined surface 7*h* formed in the wind-up side of the engaging surface 7*k*.

4 Claims, 2 Drawing Sheets

7-2
7x
9
10
8
6
6a
6b
6c
6d
6e
5
5a
5b
5c
5d
G1
7-1
7a-1
7a-2
7b
7c
7d
7e
7f
7g
7h
7j
7k
7l
13
13a
13b
13c
13d
14
14a
14b
14c
15
16
16a
16b
16c
16d
17
17a

LEVER HOIST

FIELD OF THE INVENTION

The present invention relates to a lever-type hoist and more particularly to a lever-type hoist which is capable of instant idling without resort to manipulating an operating wheel for initiation of idling.

BACKGROUND OF THE INVENTION

DESCRIPTION OF THE RELATED ART

As a lever-type hoist, the present applicant previously proposed one disclosed in Japanese Patent Kokai H7-247096.

The above lever-type hoist is a hoisting device wherein a pressure receiving member rigidly secured to a drive shaft is rotated by a press drive member through a reverse rotation stop ring and a pair of friction members disposed on both sides of said stop ring, with a coil spring being interposed between said press drive member and a rotation limiting member disposed axially forwardly of said press drive member and adapted to co-revolve with said drive shaft as a unit to apply a biasing torque in the direction releasing the pressing force of the press drive member on the pressure receiving member.

However, the lever-type hoist disclosed in the above patent application involves a delicate assembling procedure, that is to say assembly must be done while ends of the coil spring are engaged with a rib of the press drive member and a rotation limiting projection of a rotation restricting member, respectively.

Thus, in mounting the rotation restricting member on the splined part of the drive shaft following mounting of the press drive member onto the drive shaft and interposing of the coil spring, both ends of the coil spring must be circumferentially urged into engagement with the rib of the press drive member and the rotation limiting projection of the rotation restricting member, respectively, but this procedure requires more than ordinary skill.

Furthermore, since this conventional lever-type hoist includes said coil spring interposed between the press drive member thread-connected to the drive shaft and the rotation restricting member spline-coupled to the drive shaft axially forwardly of said press drive member, a slight axial clearance is required between the coil spring and each of the press drive member and the rotation restricting member but because of this axial clearance, the coil spring may happen to be disengaged from the rib and projection when the rotation restricting member rotates in the wind-up direction.

The present invention has for its object to overcome the above-mentioned disadvantages of the prior art hoist and provide a lever-type hoist in which the necessary biasing force acting in a wind-down direction on the press drive member can be obtained easily and positively to thereby facilitate an idling operation under no load and which can be easily assembled on a high production scale.

SUMMARY OF THE INVENTION

The lever-type hoist of the present invention comprises a drive shaft connected at its base end to a load sheave through a transmission gear series, a pressure receiving member rigidly secured to said drive shaft, a press drive member threaded onto an axially forward part of said pressure receiving member in such a manner that it may travel forward and backward and can be rotated by means of an operating handle when necessary, a reverse rotation stop ring interposed between said pressure receiving member and said press drive member and rotatable in a wind-up direction only, and a pair of friction members disposed on both sides of said reverse rotation stop ring in such a manner that they may be pressed by said press drive member, said lever-type hoist being characterized in that it further comprises a coil spring interposed between said pressure receiving member and said press drive member, said coil spring having a base end engaging portion and a tip end engaging position at its base and tip, respectively, a first rotation arresting means disposed at the forward side of said pressure receiving member and adapted to engage the base end engaging portion of said coil spring to arrest rotation of the coil spring in the wind-up direction with respect to the pressure receiving member, and a second rotation arresting means disposed at the base side of said press drive member and adapted to engage the tip end engaging portion of the coil spring to arrest rotation of the press drive member in the wind-up direction with respect to the coil spring.

In a further aspect, the present invention is characterized in that, in addition to the above construction, said pressure receiving member is formed with an axially forwardly projecting boss on which said reverse rotation stop ring and said friction members are mounted, said boss is provided with an axially forwardly open boss hole for accepting the base end portion of said coil spring, said boss hole is formed with a radially outwardly extending engaging groove which opens at the axially forward side of said boss, and said press drive member is formed with a spring-loading hole opening at the axially base side for accepting the tip end portion of said coil spring and an inclined surface inclined in the axially forward direction while approaching closer to the wind-down position, said second rotation arresting member being disposed in the wind-down position of said inclined surface.

In the lever-type hoist according to the present invention, the coil spring interposed between the pressure receiving member and press drive member applies a circumferential biasing force to the press drive member so as to separate the press drive member apart from the pressure receiving member.

Thus, upon mere setting of the change lever in neutral position, the press drive member is automatically separated from and maintained apart from the pressure receiving member. Therefore, an idling operation can be established without resort to manipulating the operating wheel.

In addition, when the press drive member is provided with an inclined surface, the coil spring can be set in position by mere threading of the press drive member along the drive shaft, with the result that assembling work is facilitated for enhanced productivity.

Furthermore, since the coil spring to be interposed between the pressure receiving member and the press drive member can be set in position without requiring clearances from the respective members, the engaging groove of the pressure receiving member can be positively engaged with the engaging surface of the press drive member, with the consequence that there is no risk of the coil spring being disengaged during operation, thus insuring safety.

DETAILED DESCRIPTION OF THE PREFERRED EMBODIMENTS

The lever-type hoist of the present invention is now described in detail.

Figure 1:
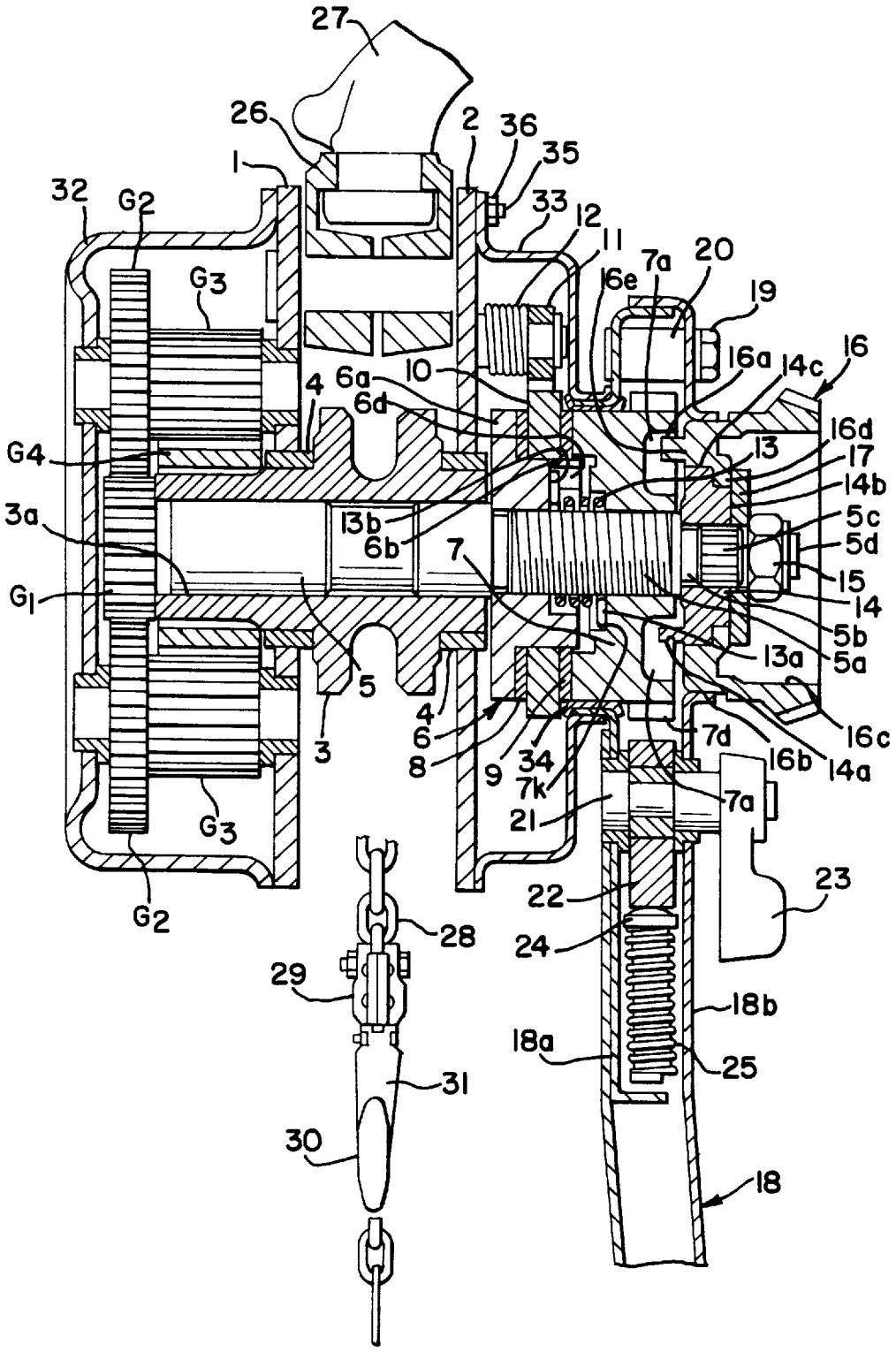
FIG. 1 is a longitudinal section view of a lever-type hoist embodying the principles of the invention.
Figures 2, 3:
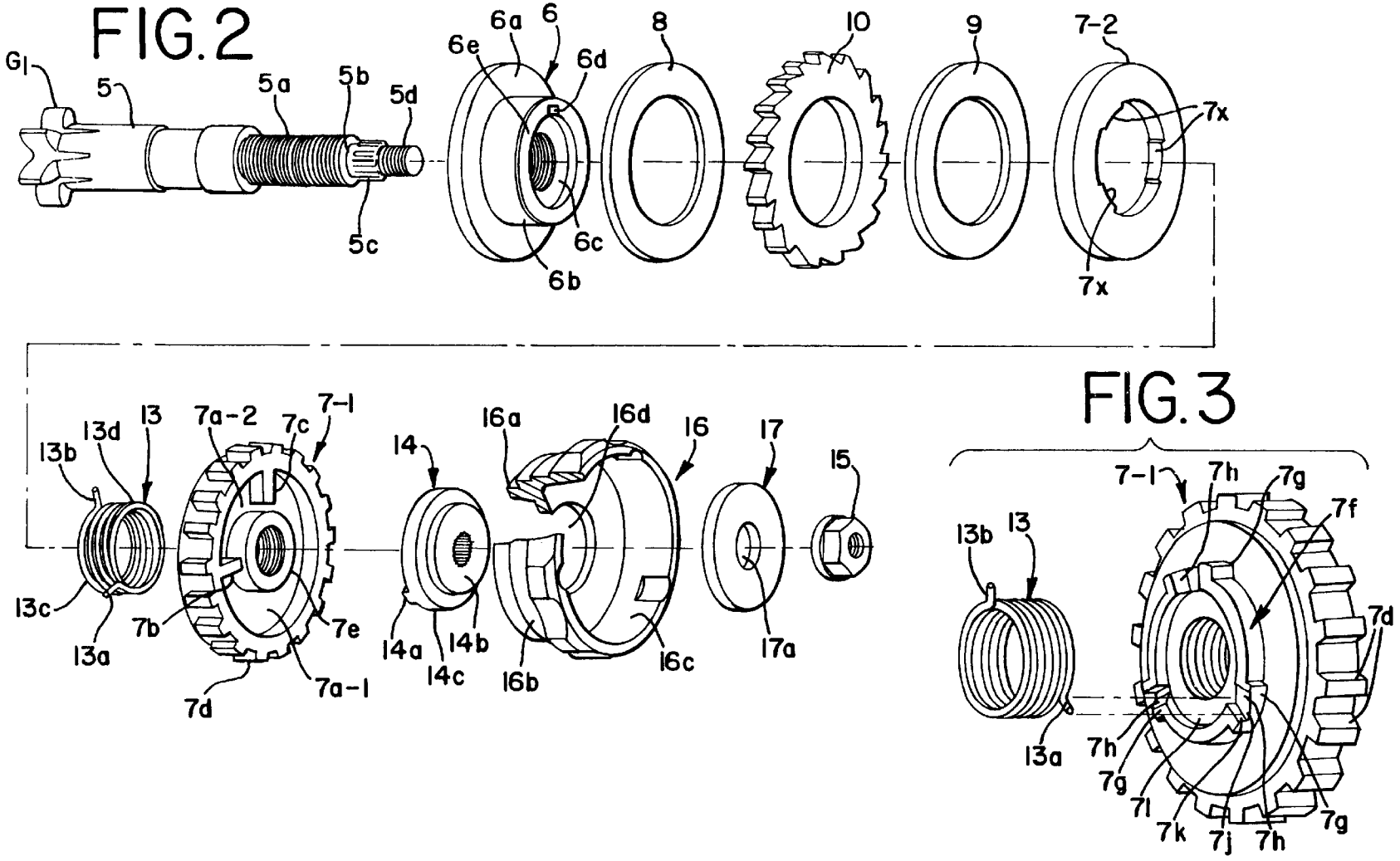
FIG. 2 is a disassembled perspective view of the cardinal elements of a lever-type hoist embodying the principles of the invention.
FIG. 3 is a perspective view of a press-drive member, as viewed from the axial inward direction, of the lever-type hoist illustrated in FIG. 2.

FIG. 1 is a longitudinal section view of a lever-type hoist embodying the principles of the invention and FIG. 2 is a disassembled perspective view of the cardinal elements of a lever-type hoist embodying the principles of the invention.

Referring to FIG. 1, a load sheave 3 interposed between a pair of side plates 1, 2 disposed in parallel with a predetermined spacing is journaled by means of bearings 4, 4. The load sheave 3 is formed with a shaft hole 3*a* extending through its center and a drive shaft 5 is rotatably accommodated in this hole 3*a*. Both ends of the drive shaft 5 extend from the corresponding sides of the load sheave 3.

The right-hand extension of the drive shaft 5 is provided with a means for driving the load sheave 3. This extension is formed, in the following order reckoning the side closer to the side plate 2 as the base end and the farther or right-hand side as the forward end, with a first threaded portion 5*a*, a shaft portion 5*b*, a spline portion 5*c*, and a second threaded portion 5*d*. The threaded portions 5*a*, 5*d* are both right-hand or clockwise-threaded. Rigidly mounted on the left-hand extension of the drive shaft 5 is a pinion gear $G_1$ which is coupled to the load sheave 3 through a reduction gear series $G_2$, $G_3$, $G_4$. The gears $G_1$–$G_4$ are covered with a cover 32 attached to the side plate 1.

Mounted in mesh with the first threaded portion 5*a* of the drive shaft 5 are a pressure-receiving member 6 and a press-drive member 7 in the order of increasing distance from the side plate 2, and the pressure-receiving member 6 has been screwed into the innermost part of the first threaded portion 5*a* and fixedly secured in position.

This pressure-receiving member 6 has a disk portion 6*a* and a boss portion 6*b*. While the disk portion 6*a* is disposed adjacent to the side plate 2, the boss portion 6*b* is designed to project axially from the center of the disk 6*a* in the right-hand direction (toward the axially forward side). The boss portion 6*b* of pressure-receiving member 6 is formed with a boss hole 6*c* having a diameter somewhat larger than the outer diameter of a coil spring 13, which is open in the axially forward direction. In addition, a part of the circumferential wall defining the boss hole 6*c* is formed with an engaging groove 6*d* (a first rotation arresting means) which extends axially from the axially forward surface 6*e* to the bottom or innermost end of the boss hole 6*c*. Sleeved over said boss 6*b* are a pair of friction members 8, 9 and, as interposed therebetween, a reverse rotation stop ring 10.

The outer periphery of said reverse rotation stop ring 10 is formed with engaging teeth inclined in one circumferential direction. It is so designed that the reverse rotation stop ring 10 and the friction members 8, 9 disposed on both sides thereof are pressed together by the press-drive member 7 so that they are sandwiched as a unit between the disk portion 6*a* of pressure-receiving member 6 and the press-drive member 7.

A ratchet pawl 11 is pivotally supported by the side plate 2 and biased by a spring 12 against the outer periphery of the reverse rotation stop ring 10. This ratchet pawl 11 is engaged by the engaging teeth of the reverse rotation stop ring 10 so that the reverse rotation stop ring 10 may rotate exclusively in the wind-up direction of the load sheave 3.

While the press-drive member 7 thread-coupled onto the first threaded portion 5*a* for optionally forward or backward movement may be an integral unit as illustrated in FIG. 1, it may be formed as two discrete elements, namely a body 7-1 and a pressure plate 7-2 as shown in FIG. 2.

FIG. 3 is a perspective view, as viewed from the axial inward side, of the body 7-1 of the press-drive member 7.

According to the embodiment wherein said press-drive member 7 is formed as two discrete elements, viz. body 7-1 and pressure plate 7-2, the increased-diameter projections 7*g* formed integrally with a boss-shaped projection 7*f* of the body 7-1 are disposed between reduced-diameter projections 7*x* formed integrally with the pressure plate 7-2 and the increased-diameter projections 7*g* are abutted against the reduced diameter portions 7*x*, whereby the body portion 7-1 and the pressure plate 7-2 act as a unit. In addition, the geometric relation between the increased-diameter portion 7*g* of body 7-1 and the reduced-diameter projection 7*x* of pressure plate 7-2 permits slight relative rotation of body 7-1 and pressure plate 7-2, with the result that even if the pressure plate 7-2 is caused to sink into the friction member 9, this biasing (sinking) force of pressure plate 7-2 on the friction members etc. can be released by applying an impact force to the pressure plate 7-2 using the operating wheel 18.

The press drive member 7 is formed with an annular recess 7*a* on the axially forward side thereof and this annular recess 7*a* is provided with a first projection 7*b* and a second projection 7*c*, both extending radially, whereby the anular recess 7*a* is divided into two sectors 7*a*-1 and 7*a*-2 which are widely different in central angle as illustrated in FIG. 2.

The axially backward side of the body 7-1 of press drive member 7 is formed with an annular projection 7*f* projecting in the axially backward direction and its circumferential wall is formed with at least one inclined surface 7*h* for guiding a forward end engaging portion 13*a* of a coil spring 13. In the illustrated embodiment, three such inclined surfaces 7*h* are disposed at equal intervals of 120 degrees. The inner diameter of said annular projection 7*f* constitutes a spring loading hole 71 approximating the outer diameter of the coil spring 13.

Each inclined surface 7*h* is formed from the axially backward side toward the axially forward side of said annular projection 7*f* in such a manner that it increases in axial depth in the wind-down direction. This inclined surface 7*h* is provided with a small surface 7*j* normal to the axial direction near the wind-down position and, further, an engaging surface (a second rotation-arresting means) 7*k* extending axially in the wind-down position. The axial depth of the inclined surface 7*h* corresponds to the level of the bottom of spring-loading hole 71. The circumferential side wall where the inclined surface 7*c* is formed extends radially outwardly to form an increased-diameter projection 7*g*.

The pressure plate 7-2 of press drive member 7 is in the form of a short cylinder with the its inner diameter being slightly larger than the diameter of said increased-diameter projection 7*g* of body 7-1. In addition, the inner-diameter surface of pressure plate 7-2 is formed with radially inwardly projecting reduced-diameter projections 7*x*, the diameter of which is larger than the diameter of the annular projection 7*f* of body 7-1 and smaller than the diameter of said increased-diameter projection 7*g*.

Fitted to a spline 5*c* of the drive shaft 5 is a rotation-restricting member 14 in adjacency to the press drive member 7. The rotation-restricting member 14 is formed with a rotation-limiting projection 14*a* on its side facing the press drive member 7, while the opposite side of said rotation-limiting member 14 is formed with a boss 14*b* projecting out in the axial direction.

Positioning of the rotation-restricting member 14 with respect to the press drive member 7 is carried out by, for example, engaging the rotation-restricting member 14 with the spline 5*c* of the drive shaft 5 in such a manner that with the press drive member 7 having been fully displaced in the wind-up direction to press the friction members, the rotation-limiting projection 14*a* will be engaged with the spline 5*c* of drive shaft 5 at an angle of about 30 degrees in the wind-down direction with respect to the first projection 7*b* of the press drive member 7. In this manner, the rotation-limiting projection 14*a* projecting into the larger anular recess 7*a*-1 is abutted against the first projection 7*b* to thereby inhibit rotation of the drive press member 7 beyond a necessary extent with respect to the drive shaft 5, thus precluding excessive displacement of press drive member 7 in the axially outward direction.

The coil spring 13 is left-handed, with its ends being bent radially outwardly to constitute a base end engaging portion 13*b* and a tip engaging portion 13*a*. The opening angle between the base engaging portion 13*b* and tip engaging portion 13*a* of the coil spring 13 can be liberally selected, and is about 60–90 degrees in the illustrated embodiment. The coil spring 13 should have a spring force allowing winding-up without undue resistance when the press drive member is driven with a load on the load sheave.

The coil spring 13 is loosely fit over the drive shaft 5 and its base portion 13*c* is passed into a boss hole 6*c* of pressure-receiving member 6 while its tip portion 13*d* is inserted into a spring loading hole 71 of press drive member 7. The coil spring 13 is set with its base engaging portion 13*b* engaged by an engaging groove (a first rotation-arresting means) 6*d* of pressure receiving member 6 and its tip engaging portion 13*a* abutted against an engaging surface (the second rotation arresting means) 7*k* formed in the wind-down position of the inclined surface 7*h* of press drive member 7.

In assembling, with the base engaging portion 13*b* of coil spring 13 fitted in the engaging groove 6*d* of pressure receiving member 6 and one side portion of the coil spring 13 inserted in the boss hole 6*c*, the press drive member 7 is advanced along the first threaded portion 5*a* of the drive shaft 5, whereby the tip engaging portion 13*a* of coil spring 13 is automatically engaged with the engaging surface 7*k* of press drive member 7. Thus, because the depth is increased in the wind-down direction along the inclined surface 7*h*, advancing of the press drive member 7 in the wind-up direction automatically leads the tip engaging portion 13*a* of coil spring 13 to the engaging surface 7*k* of press drive member 7. Furthermore, it is advantageous to provide a plurality each of inclined surfaces 7*h*, engaging surfaces 7*h* and engaging surfaces 7*k*, for then every several fractions of one revolution of the press drive member 7 in the wind-up direction results in a stop, thus further facilitating engagement with the coil spring 13 and, moreover, the coil spring 13 can be set to the optimum strength.

In the above arrangement, as the base engaging portion 13*b* of coil spring 13 is engaged with the engaging groove 6*d*, the tip engaging portion 13*a* engaged with the engaging surface 7*k*, and the press drive member 7 rotated in the wind-up direction, the coil spring 13 is deformed so that a circumferential biasing force acts on the press drive member 7 to screw it back from the pressure receiving member 6 toward the axially forward end. In addition, the press drive member 7 is also subjected not only to a counterclockwise rotational force screwing it back but also to an axial force biasing it axially outwardly against the pressure receiving member 6.

In disassembling the hoist for changing worn parts such as the friction members, the press drive member 7 is rotated in the wind-down direction, whereupon the tip engaging portion 13*a* of the coil spring 13 is disengaged from the engaging surface 7*k* and, then, slides on the inclined surface 7*h* so that the press drive member 7 can be continuously rotated in the wind-down direction without interference, thus allowing disassembling to be completed in a short time.

For the purpose of facilitating disassembly, it may be so arranged that, instead of providing the press drive member 7 with said inclined surface 7*h*, the pressure receiving member 6 may be formed with an inclined surface which is increasingly elevated in the axially forward direction from the bottom of the engaging groove 6*d* (first rotation-arresting means) of the pressure receiving member 6 in continuation from the wind-down side of said groove 6*d*. However, it is preferable to provide the press drive member 7 with such inclined surfaces as shown, for assembling can then be easily carried out by mounting the coil spring 13 on the pressure receiving member 6 and screwing in the pressure drive member 7.

Rotatably mounted on the outer periphery of the boss portion 14*b* of rotation limiting member 14 is an operating wheel 16. This operating wheel 16 is so formed as to be in plane contact with the outer periphery of the rotation restricting member 14 and has a recess 16*c* at its axially forward side. In addition, the outer periphery of the operating wheel 16 is formed with irregularities so as to make it easy to grasp and rotate the wheel 16.

The bottom wall of the operating wheel 16 which faces the press drive member 7 is provided with a pressure release projection 16*a* adapted to fit into the smaller anular recess 7*a*-2 of press drive member 7. The pressure release projection 16*a* is abutted against the second rib 7*c* of the press drive member 7 to rotate the member 7 by inertia or by a force applied in the wind-down direction to thereby displace the press drive member 7 toward the axially forward side.

Fitted in the recess 16*c* of the operating wheel 16 is a washer 17, with the drive shaft 5 piercing through its shaft hole 17*a*, and this washer 17 is rigidly secured to the inner bottom wall of the operating wheel 16 by a nut 15 screwed onto the second threaded portion 5*d* of the drive shaft 5. The outer diameter of the washer 17 is slightly larger than the diameter of the shaft hole 16*d* in the bottom wall of the operating wheel 16. Therefore, even if the operating wheel 16 is pulled outwardly, it will not be disengaged from the rotation restricting member 14, nor will be affected the engagement of the pressure release projection 16*a* with the two projections 7*b*, 7*c*. The rotation restricting member 14 is so formed so that the end face of the boss portion 14*b* will be disposed slightly lower than the inner bottom wall of wheel 16.

The gear 7*d* portion of the press drive member 7 is housed in an operating handle 18.

The operating handle 18 consists of an inner case 18*a* and an outer case 18*b*. The inner case 18*a* is provided with an opening surrounding the friction member 9 side of press drive member 7 and the outer case 18*b* is provided with an opening surrounding the outer periphery of the bottom wall portion 16*b* of operating wheel 16. The inner case 18*a* and outer case 18*b* are connected to each other by a plurality of screws 19, 19, . . . and nuts 20, 20, . . . to form a unit.

The operating handle 18 extends below the press drive member 7 and is internally provided with a rotational direction switch pawl 22. This rotational direction switch pawl 22 is supported rotatably by a shaft 21 with respect to the two handle cases 18*a*, 18*b*.

The shaft 21 projects out of the operating handle 18 and is fitted with a switch lever 23 at its projecting portion.

Upon switching of this switch lever 23, the rotational direction switch pawl 22 is engaged allowing rotation either in the wind-up (UP) direction or in the wind-down (DOWN) direction, or in neutral position where no rotation can occur in either direction. Abutted against the lower end of the rotational direction switch pawl 22 is a pressure member 24 biased upward by a spring 25, whereby the rotational direction switch pawl 22 is resiliently supported in a predetermined switch position.

Disposed atop between the two side plates 1, 2 via a connecting metal 26 is an upper hook 27. Connected to the lower end of a load chain 28 taken up on the load sheave 3 via a connecting metal 29 is a lower hook 30 for suspending a load. The reference numeral 31 represents a metal for preventing disengagement of a load, which is pivoted to the top of the lower hook 30 in such a manner that it is rotatable selectively inwardly. Indicated at 33 is a cover attached to the side plate 2 by a plurality of screws 35 and nuts 36. The cylindrical opening in the center of this cover 33 is superposed on the periphery of the cylindrical opening of inner case 18*a* in such a manner that the operating handle 18 may be rotated in both directions.

A cylindrical stopper member 34 with a bracket-like sectional configuration is inserted on the inner side of the cylindrical opening of inner case 18*a* for controlling the axial displacement of the operating handle 18. This cylindrical stopper member 34 is made, for example, of steel.

The operation of the lever-type hoist according to this embodiment is now explained.

For idling, the switch lever 23 is set in neutral position.

When the switch lever 23 is set in neutral position, under no load the biasing force of the coil spring 13 causes the press drive member 7 to rotate in the wind-down direction with agility and move axially forwardly along the first threaded portion 5*a* of the drive shaft 5 and away from the friction member 9. As a result, an idling operation can be immediately started by pulling the chain 28 without the need to manipulate the operating wheel 16 for rotation. The press drive member 7 is prevented from being driven further axially forwardly after its first projection 7*b* has been abutted against the rotation limiting projection 14*a* of rotation restricting member 14.

On the other hand, the spring force of coil spring 13 for idling is so weak that under a load the drive shaft 5 is subjected to a force urging it to turn counterclockwise, i.e. in the hoist-down direction and, in addition, an engaging tooth of the reverse rotation stop ring 10 is in mesh with the ratchet pawl 11 of the ratchet gear. Therefore, the press drive member 7 is rotated in the wind-up direction to press the friction members 8, 9 and reverse rotation stop ring 10 against the pressure receiving member 6 to maintain the braking effect and insure safety.

For hoisting a load up, the switch lever 23 is set to the wind-up (UP) direction in the first place and the operating handle 18 is then turned to and fro about the drive shaft 5. For hoisting down the load, the switch lever 23 is set to the wind-down (DOWN) direction and the operating handle 18 is then rotated to and fro about the drive shaft.

What is claimed is:

1. A lever-type hoist comprising a drive shaft connected at its base end to a load sheave through a transmission gear series, a pressure receiving member rigidly secured to said drive shaft, a press drive member threaded onto an axially forward part of said pressure receiving member in such a manner that it may travel forward and backward and can be rotated by means of an operating handle when necessary, a reverse rotation stop ring interposed between said pressure receiving member and said press drive member and rotatable in a wind-up direction only, a pair of friction members disposed on both sides of said reverse rotation stop ring in such a manner that they may be pressed by said press drive member, characterized in that said hoist further comprises a coil spring interposed between said pressure receiving member and press drive member, said coil spring having a base end engaging portion and a tip end engaging portion at its base and tip, respectively, a first rotation arresting means disposed at the forward side of said pressure receiving member and adapted to engage the base end engaging portion of said coil spring to arrest rotation of the coil spring in the wind-up direction with respect to the pressure receiving member, and a second rotation arresting means disposed at the base side of said press drive member and adapted to engage the tip end engaging portion of the coil spring to arrest rotation of the press drive member in the wind-up direction with respect to the coil spring.

2. The lower-type hoist according to claim 1 further characterized in that said pressure receiving member is formed with an axially forwardly projecting boss on which said reverse rotation stop ring and said friction members are mounted, said boss is provided with an axially forwardly open boss hole for accepting the base end portion of said coil spring, said boss hole is formed with a radially outwardly extending engaging groove which opens at the axially forward side of said boss, and said press drive member is formed with a spring-loading hole opening at the axially base side for accepting the tip end engaging portion of said coil spring and an inclined surface inclined in the axially forward direction while approaching closer to the wind-down position, said second rotation arresting means being disposed in the wind-down position of said inclined surface.

3. The lever-type hoist according to claim 2 further characterized in that the threaded portion of said drive shaft which is engaged by said press drive member is formed as a right-handed thread, said coil spring is left-handed, with both ends being bent to form said base engaging portion and tip end engaging portion, respectively, the second rotation arresting means formed in said press drive member comprises an engaging surface formed in the wind-down position of the inclined surface of said press drive member in parallel with the axis, the base end engaging portion of said coil spring is engaged by the engaging groove of said pressure receiving member while the tip end engaging portion is engaged by the engaging surface of said press drive member.

4. The lever-type hoist according to claim 3 further characterized in that said press drive member is formed with a plurality of units of said second rotation arresting means.

* * * * *